US010490376B2

(12) United States Patent
Kuroda et al.

(10) Patent No.: US 10,490,376 B2
(45) Date of Patent: Nov. 26, 2019

(54) RIVET-TYPE CONTACT AND METHOD FOR MANUFACTURING THE SAME

(71) Applicant: Tanaka Kikinzoku Kogyo K.K., Tokyo (JP)

(72) Inventors: Masao Kuroda, Tomioka (JP); Hiroshi Shirahata, Tomioka (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 0 days.

(21) Appl. No.: 14/649,263

(22) PCT Filed: Dec. 13, 2013

(86) PCT No.: PCT/JP2013/083421
§ 371 (c)(1),
(2) Date: Jun. 3, 2015

(87) PCT Pub. No.: WO2014/092173
PCT Pub. Date: Jun. 19, 2014

(65) Prior Publication Data

US 2016/0217956 A1 Jul. 28, 2016

(30) Foreign Application Priority Data

Dec. 14, 2012 (JP) ..... 2012-273136

(51) Int. Cl.
*H01H 50/54* (2006.01)
*H01H 1/021* (2006.01)
(Continued)

(52) U.S. Cl.
CPC ..... *H01H 50/54* (2013.01); *H01H 1/021* (2013.01); *H01H 11/042* (2013.01); *H01H 1/023* (2013.01); *H01H 2203/004* (2013.01)

(58) Field of Classification Search
CPC ..... H01H 11/042; H01H 50/54; H01H 1/021; H01H 1/023; H01H 2203/004
See application file for complete search history.

(56) References Cited

U.S. PATENT DOCUMENTS 3,026,603 A * 3/1962 Zysk ..... B21K 1/62 200/267
3,191,276 A * 6/1965 Gwyn, Jr. ..... B21K 1/62 200/267

(Continued)

FOREIGN PATENT DOCUMENTS

JP 4024580 B1 10/1965
JP S61101920 A 5/1986

(Continued)

OTHER PUBLICATIONS

PCT, International Search Report PCT/JP2013/083421, dated Feb. 10, 2014.

*Primary Examiner* — Bernard Rojas
(74) *Attorney, Agent, or Firm* — Orrick, Herrington & Sutcliffe LLP; Joseph A. Calvaruso; K. Patrick Herman

(57) ABSTRACT

A rivet-type contact of the present invention has a head part made of a contact material, and a leg part narrower than the head part in width and configured to be deformed at fixation. The leg part includes a flange part larger than the leg part in diameter, in an end part of the side of the head part, the flange part is embedded in the head part such that a lower end surface of the flange part and a lower end surface of the head part become approximately flat, and a length (l) between an endmost part of the flange part and a starting point of the leg part satisfies $l<L$ with respect to a length (L) between an endmost part of the head part and the starting point of the leg part. Specifically, it is favorable that l satisfies $0.5L \leq l \leq 0.9L$ with respect to L.

6 Claims, 5 Drawing Sheets

SIDE SURFACE OF FLANGE PART IS INCLINED

UPPER SURFACE OF FLANGE PART IS RECESSED

(51) Int. Cl.
*H01H 11/04* (2006.01)
*H01H 1/023* (2006.01)

(56) References Cited

U.S. PATENT DOCUMENTS 3,605,262 A * 9/1971 Shibata ..... H01H 1/023
29/877
4,414,742 A * 11/1983 Shibata ..... B23K 33/00
228/115

FOREIGN PATENT DOCUMENTS

JP S62163213 A 7/1987
JP 02227919 A * 9/1990 ..... H01H 1/04
JP H05282957 A 10/1993
JP 3098834 A 10/2003

* cited by examiner

SIDE SURFACE OF FLANGE PART IS INCLINED

UPPER SURFACE OF FLANGE PART IS RECESSED

UPPER SURFACE OF FLANGE PART IS ARC-SHAPED

FIRST BILLET AND SECOND BILLET ARE JOINED AND JOINED MATERIAL IS MANUFACTURED

JOINED MATERIAL IS FORMED INTO RIVET SHAPE

HEAD PART IS PRESSED AND FINISH-MOLDED

RIVET-TYPE CONTACT AND METHOD FOR MANUFACTURING THE SAME

TECHNICAL FIELD

The present invention relates to a rivet-type contact and a method for manufacturing the same, and especially relates to a rivet-type contact that can decrease the amount of use of a contact material such as an Ag alloy, and has a good durability life.

BACKGROUND ART

As a fixed contact and a movable contact of a relay, a switch, or the like, rivet-type contacts have been conventionally used. The rivet-type contacts are made of a head part that acts as an electric contact, and a leg part that is deformed by caulking when being fixed to various devices. Then, at fixation of the rivet-type contact, the leg part of the rivet-type contact is inserted into a hole drilled in a base in advance, and is pressed with a caulking tool from a back side (leg part side). With the caulking processing, the diameter of the leg part is increased and the leg part is closely attached to a wall surface of the hole, and the diameter of an end part of the leg part becomes larger than that of the hole, so that the fixation is made.

In the past, the entire rivet-type contact has been configured from a contact material. However, an Ag alloy or the like, which is the contact material, is expensive. Therefore, to decrease the material cost, a two-layer rivet-type contact has been typically used, in which the contact material is partially applied, and a relatively low cost material (base material) such as copper or a copper alloy is applied to other parts.

As a configuration of the two-layer rivet-type contact, one in which the head part is formed into a two-layer structure, an upper surface part of the head part is configured from the contact material, and a lower surface part of the head part and the leg part are made of the base material such as Cu is known, for example (FIG. 7(a), see Patent Document 1). In a process of manufacturing the two-layer rivet-type contact, first, a columnar contact material and a base material are pressure-welded and integrated, preliminary processing and molding processing are performed, and a two-layer structure made of a head part and a leg part is formed.

Further, as the two-layer rivet-type contact, there are one in which the above-described head part is formed into a two-layer structure, and one in which the entire head part is configured from the contact material and the leg part is configured from the base material (FIG. 7(b), see Patent Document 2). These types of two-layer rivet-type contacts are manufactured such that a columnar leg part (base material) is brazed to a disk head part (contact material).

RELATED ART DOCUMENT

Patent Documents

Patent Document 1: JP 5-282957 A
Patent Document 2: JP 3098834 U

SUMMARY OF THE INVENTION

Problems to be Solved by the Invention

Conventional two-layer rivet-type contacts are satisfactory in terms of achievement of both of a member cost and a contact function. However, according to the present inventors, the conventional two-layer rivet-type contacts have problems of being inferior to single-layer rivet-type contacts in durability life, and being damaged relatively early.

Forms of the damage caused in the conventional two-layer rivet-type contacts mainly include separation and dropping out of the head part associated with consumption of a contact material part of the head part. The fixed contact (rivet-type contact) in an electrical device such as a relay is subject to a load of arc heat/Joule heat when coming in contact with the movable contact. Although an Ag-based alloy having wear resistance is applied to the contact material in consideration of the heat load and friction, the consumption cannot be completely eliminated even in such a case.

Further, in the fixed contact of a relay or the like, a load is often applied to an end part due to its structure, and the loaded part is severely consumed. Therefore, in the rivet-type contact (FIG. 7(*a*)) in which an upper surface of the head part is configured from the contact material, the contact material is consumed from the end part and becomes thin, and is sometimes separated from the end part. Accordingly, the movable contact comes in contact with the base material, and the contact may become a cause of failure of the device.

Further, when the entire head part is configured from the contact material (FIG. 7(*b*)), the base material (leg part) cannot be exposed even if the end part is preferentially consumed. Therefore, separation of the contact material as described above will not happen. However, in such a form of rivet-type contact, the entire head part may sometimes be dropped out regardless of existence or non-existence of the consumption of the contact material. Although the dropping out of the contact material will not always happen, it may lead to serious failure of the device.

The problems in the two-layer rivet-type contacts are assumed to be caused due to the configuration of combination of different materials. However, the configuration is rational when the member cost is considered. Therefore, the point is to give consideration to the durability. The present invention provides a rivet-type contact having a two-layer configuration, in which the separation/dropping out of the contact material as described above does not occur, and having an excellent durability life.

Means for Solving the Problems

To solve the problems, the present inventors have re-examined the problems of the two-layer rivet-type contacts. Here, the problem about the rivet-type contact in which the upper surface of the head part is configured from the contact material is that the contact material, which becomes thin due to uneven wear, is separated from the end part. Therefore, the present inventors have considered that it is favorable to avoid a structure in which the base material is exposed to a side surface of the head part.

Meanwhile, as for the phenomenon in which the entire head part drops off the two-layer rivet-type contact in which the entire head part is a contact material, first, a small joined area is considered as a cause. However, even if the joined area is small, condition setting is performed in the manufacturing process so that sufficient joining strength can be obtained. Therefore, the phenomenon of the dropout of the head part cannot so easily happen. Thus, the present inventors have further conducted examination. As a result, it has been confirmed that the cause of the dropout of the head part happen in the caulking processing for fixation of the rivet-type contact. That is, during the caulking processing, a joint part of the leg part is subject to stress concentration from a plurality of directions. This stress-concentrated part is a part corresponding to joined interface between the head part (contact material) and the leg part (base material). Since processability and hardness of the head part and the leg part are different, caulked wrinkles are caused in the vicinity of the joint of the leg part, as illustrated in FIG. 1. The caulked wrinkles become a starting point of a crack in a use process after the fixation of the contact. Then, the crack grows, so that the head part is dropped out (FIG. 1).

The present inventors have considered that, from the above examination result, it is favorable to apply two structures: (i) the base material is not exposed to the side surface of the head part; and (ii) a joined interface of different types of materials is not formed in the joint part of the leg part, in order to secure the durability regarding the configuration of the two-layer rivet-type contact in which the contact material and the base material are combined. Then, the present inventors have arrived at the present invention, which is a two-layer rivet-type contact satisfying the above conditions.

That is, the present invention is a rivet-type contact including: a head part made of a contact material; and a leg part having a narrower width than the head part, and configured to deform at fixation, wherein the leg part includes, in an end part of a side of the head part, a flange part having a larger diameter than the leg part, the flange part is embedded in the head part such that a lower end surface of the flange part and a lower end surface of the head part become approximately flat, and a length (l) between an endmost part of the flange part and a starting point of the leg part satisfies $l<L$ with respect to a length (L) between an endmost part of the head part and the starting point of the leg part.

The rivet-type contact according to the present invention is obtained such that the flange part having a larger diameter than the leg part is formed in an end part of the side of the head part regarding the shape of the leg part, as illustrated in FIG. 2, the flange part is embedded in the head part, and the head part and the leg part are joined. Accordingly, the joined interface of different types of materials does not exist in the joint part of the leg part, and occurrence of the caulked wrinkles at the time of the caulking processing is suppressed.

Further, in the rivet-type contact according to the present invention, the length (l) between an endmost part of the flange part and a starting point of the leg part satisfies $l<L$ with respect to the length (L) between an endmost part of the head part and the starting point of the leg part, on the lower end surface of the head part. In this way, the width of the flange part is made smaller than the width of the head part, and the entire flange part is embedded in the head part, so that the base material will not be exposed to the side surface of the head part. Accordingly, the separation due to consumption of the contact material can be suppressed. However, when the head part is unevenly worn, there is a high possibility that the base material is exposed if the width l of the flange part is too large, and the separation may happen. Meanwhile, a joined area is decreased and the leg part may be dropped off the head part if the width l of the flange part is too small. Considering balance of them, the width l of the flange part is favorably $0.5L \leq l \leq 0.9L$.

Further, an embedded depth (x) of the flange part is favorably 1/10 to 1/3 of a height (Y) of the head part. Joining becomes insufficient and the leg part may be drop off if the embedded depth is too shallow. In contrast, if the embedded depth is too deep, the contact material becomes thin by the depth and the durability becomes insufficient. Therefore, it is favorable to employ the above-described range in terms of balance between the joining strength and securing of the thickness of the contact material. Note that a deepest part is employed as the embedded depth of the flange part, when an upper surface of the flange part has a curved surface as described below.

Further, with regard to the shape of the flange part, a side surface of the flange part may be parallel to the side surface of the head part (FIG. 2), or may be inclined (FIG. 3(*a*)). Further, the upper surface of the flange part may be flat, may include a hollow (FIG. 3(*b*)), or may have an arc shape (FIG. 3(*c*)).

The contact material that forms the head part is favorably an Ag-based contact material. To be specific, the Ag-based contact material is pure Ag or an Ag alloy (an Ag—Ni alloy, an Ag—Cu alloy, or the like). As the Ag alloy, an oxide dispersion-type Ag alloy (an Ag—$SnO_2$-based alloy, an Ag—$SnO_2$—$In_2O_3$-based alloy, an Ag—ZnO-based alloy, or the like) can be applied. Further, as the base material that configures the leg part having the flange part, Cu or a Cu alloy (a Cu—Ni alloy, a Cu—Sn alloy, or the like) is applicable.

As a method of manufacturing the rivet-type contact according to the present invention, a leg part to which a flange part is formed, and a head part in which a recess for allowing the flange part to be embedded is formed are separately manufactured, and the leg part and the head part may be joined. However, production efficiency of the method is not very good, and moreover, the joining strength between the leg part and the head part may not be secured.

Therefore, a method of manufacturing a rivet-type contact according to the present invention includes: causing a first billet made of a contact material and a second billet made of a base material to butt against each other and pressure-welding the first billet and the second billet to manufacture a joined material; combining a joining punch having a recessed space, and a joining dice having a cylindrical space to form a rivet-shaped space; pressing the joined material into the space of the joining punch from a lower part of the joining dice; and filling the space in the joining punch with the first billet and forming a head part, and embedding a part of the second billet in the head part to form a flange part.

In the method of manufacturing the rivet-type contact according to the present invention, for a start, the first billet made of a contact material and the second billet made of a base material are pressure-welded and a joined material is obtained. This process of manufacturing the joined material is an essential process for manufacturing the rivet-type contact according to the present invention. The first billet and the second billet are firmly joined, which will help a joined surface follow deformation of the first billet (head part) in forming a flange part in the next process of forming the head part. Therefore, a load at the time of the pressure welding is favorably 0.5 to 2.0 ton·f.

The manufactured joined material is pressed into a mold formed by a combination of the joining punch and the joining dice, so that the rivet-type contact can be obtained. In this forming process, the first billet pressed into the space of the joining punch is formed into a head part shape while being deformed due to a wall surface of the joining punch, and the joined surface of the joined material follow the deformation and forms the flange part together with a part of the second billet. A load in the pressing of the joined material may be any load as long as the first billet can be deformed/processed with the load, and can be adjusted according to a type of the contact material of the first billet.

The manufacturing of the joined material and the forming processing by pressing can be performed at a normal temperature. Further, with regard to the rivet-type contact in which the head part and the flange part are formed, the head part may be appropriately pressed and molded. This molding process is useful when strict control is required for the shape and dimension of the head part.

Advantageous Effects of the Invention

As described above, the rivet-type contact according to the present invention suppresses separation/dropout of the contact material and has an excellent durability life while having a two-layer structure in which a contact material and a base material are combined.

DESCRIPTION OF EMBODIMENTS

Figure 1:
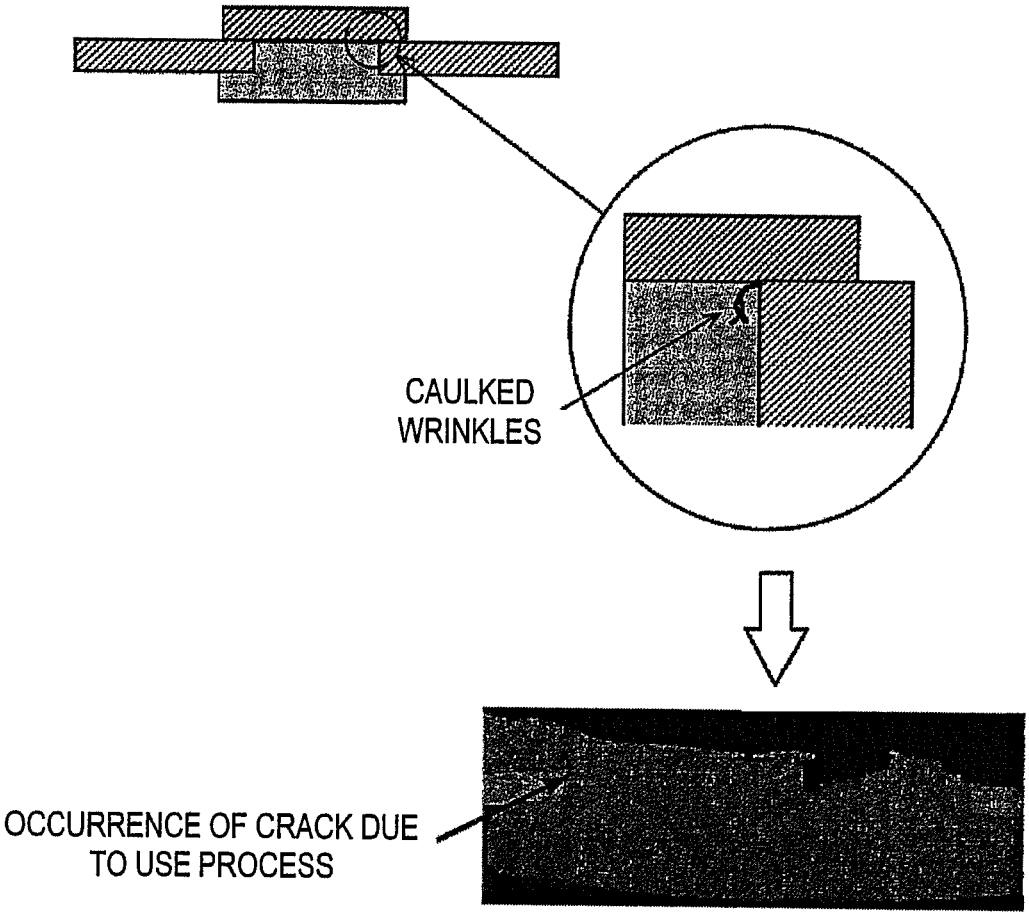
FIG. 1 Related Art
FIG. 1 is a diagram for describing occurrence of caulked wrinkles in a conventional two-layer rivet-type contact.
Figure 2:
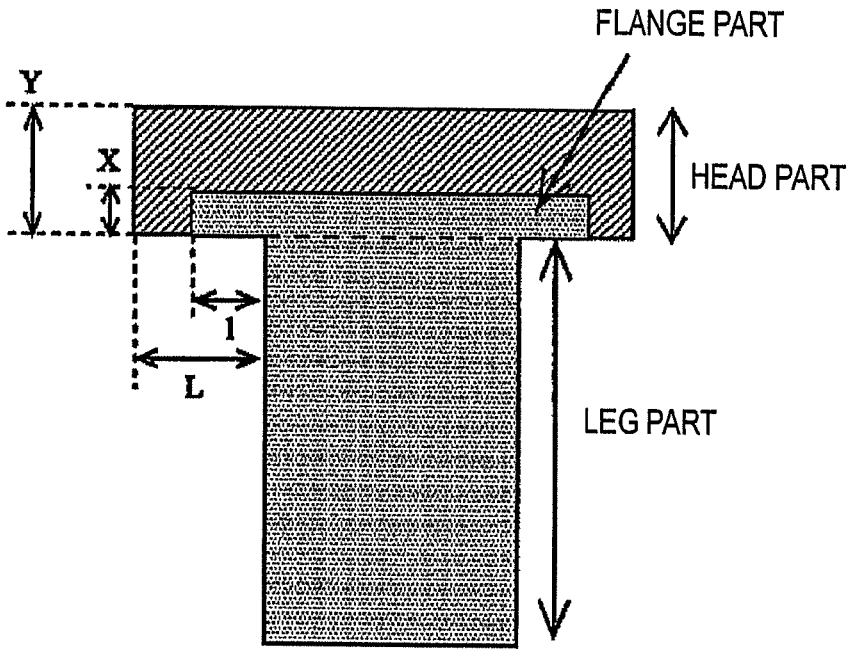
FIG. 2 is a diagram for describing a configuration of a two-layer rivet-type contact according to the present invention.
Figure 3A:
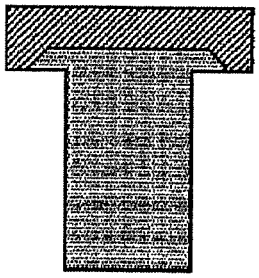
FIGS. 3(*a*) to 3(*c*) are diagrams for describing examples of configurations of the two-layer rivet-type contact according to the present invention.
Figure 3B:
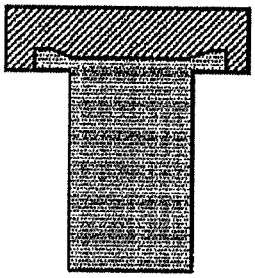
Figure 3C:
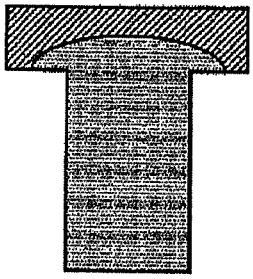
Figure 4A:
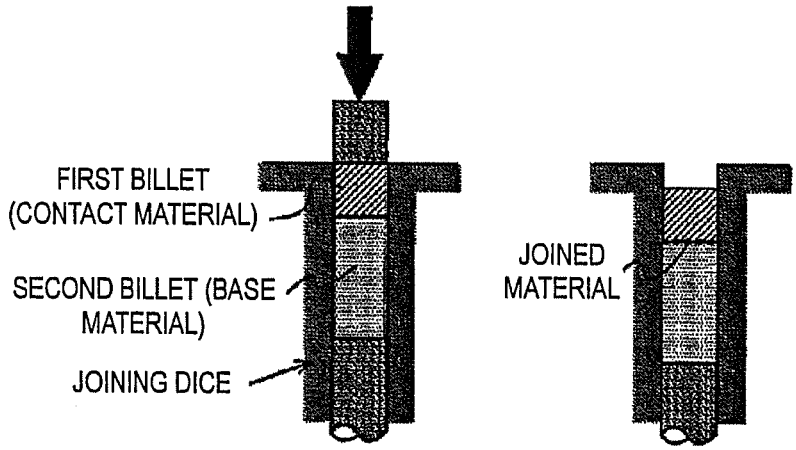
FIGS. 4(A) to 4(C) are diagrams for describing a process of manufacturing the rivet-type contact of the present embodiment.
Figure 4B:
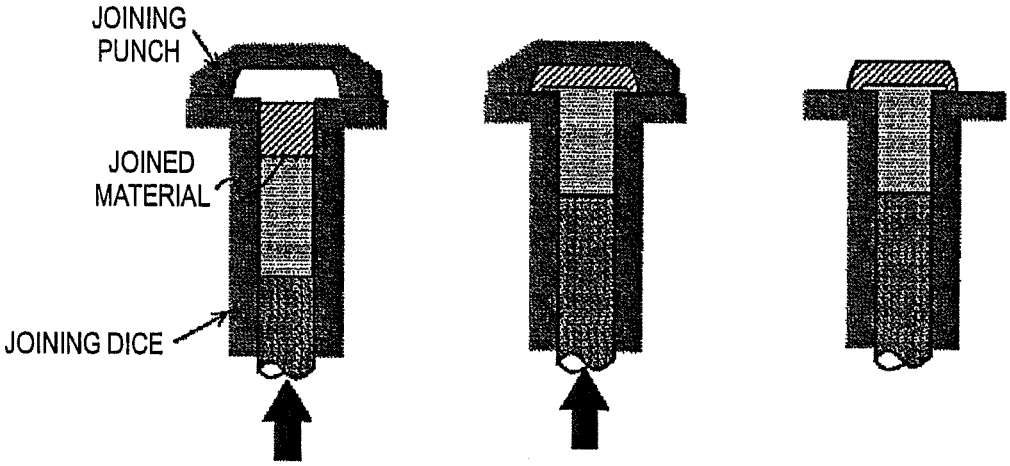

Hereinafter, a favorable embodiment of the present invention will be described. FIG. 4 illustrates a process of manufacturing a rivet-type contact according to the present embodiment. First, a columnar first billet (dimensions: ϕ1.4 mm, 0.87 mm) was cut from wire of an Ag alloy (Ag—$SnO_2$—$In_2O_3$ alloy), and a columnar second billet (dimension: ϕ1.4 mm, 1.10 mm) was cut from wire of Cu.

Then, as illustrated in FIG. 4 (A), the first billet and the second billet were layered, inserted into a joining dice, and pressure-welded, so that a joined material was obtained. The joining dice is made of cemented carbide and has a bore diameter of ϕ1.45 mm. Further, a load for joining was 0.9 ton·f. Note that, in the present embodiment, the first billet and the second billet were inserted into the joining dice, and the joining was performed. This is because adequate constraint is provided to the joined material in a cross direction so that the joined material is not excessively deformed, in addition to convenience that molding processing can be performed without any change. Here, the bore diameter of the dice into which the first billet and the second billet are inserted is favorably larger by 0.05 to 0.15 mm than the diameter of the billets.

Next, a joining punch was set on the joining dice, and the joined material was processed into a rivet shape, as illustrated in FIG. 4 (B). The joining punch is made of cemented carbide, and has a disk-shaped space with a curved side surface (dimensions: an upper surface ϕ1.68 mm, a lower surface ϕ1.8 mm, and the height 0.7 mm). In this process, the joined material was pressed into the space of the joining punch from a lower side of the joining dice at once, and the first billet part was deformed into a head part shape. At this time, a joined surface of the joined material was deformed following the deformation of the first billet part, and formed an outer shape of a flange part.

Figure 4C:
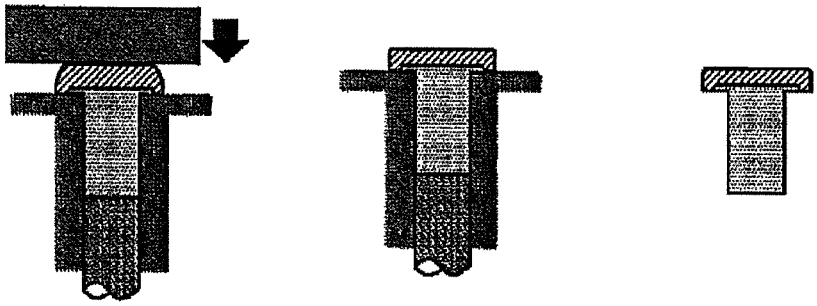

After the creation of the rivet-type contact with a molding, the joining punch was moved, and an upper surface of the head part was pressed and molded, as illustrated in FIG. 4(C). Dimensions of the rivet-type contact manufactured as described above are as follows: the head part has ϕ2.5 mm and the thickness of 0.35 mm, the leg part has ϕ1.5 mm and the length of 0.8 mm, and the flange part has ϕ2.0 mm and the height of 0.1 mm on the lower end surface of the head part.

Figure 7A:
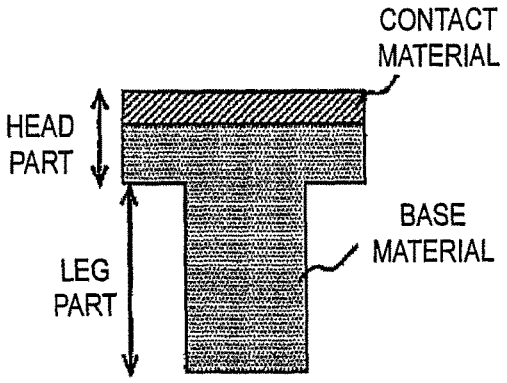
FIGS. 7(*a*) and 7(*b*) are diagrams for describing configurations of the conventional two-layer rivet-type contact.
Figure 7B:
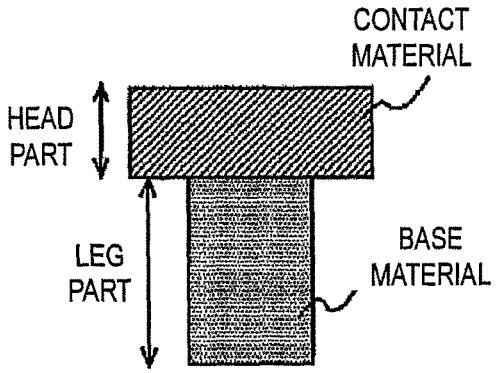

Then, the durability was evaluated with respect to the manufactured rivet-type contact. Durability evaluation was performed such that the rivet-type contact was attached to a hinge-type alternating current general relay, as a fixed contact, opening/closing operations were repeated in a state of a current load, and the number of times of opening/closing of the durability life until occurrence of failure was measured. In this evaluation test, as a comparative example, a rivet-type contact in which an Ag alloy that has the same shape as FIG. 7(*a*), and is the same as the present embodiment was joined with a Cu base material as the contact material was tested. Test conditions in the evaluation test are as follows.

Figure 5:
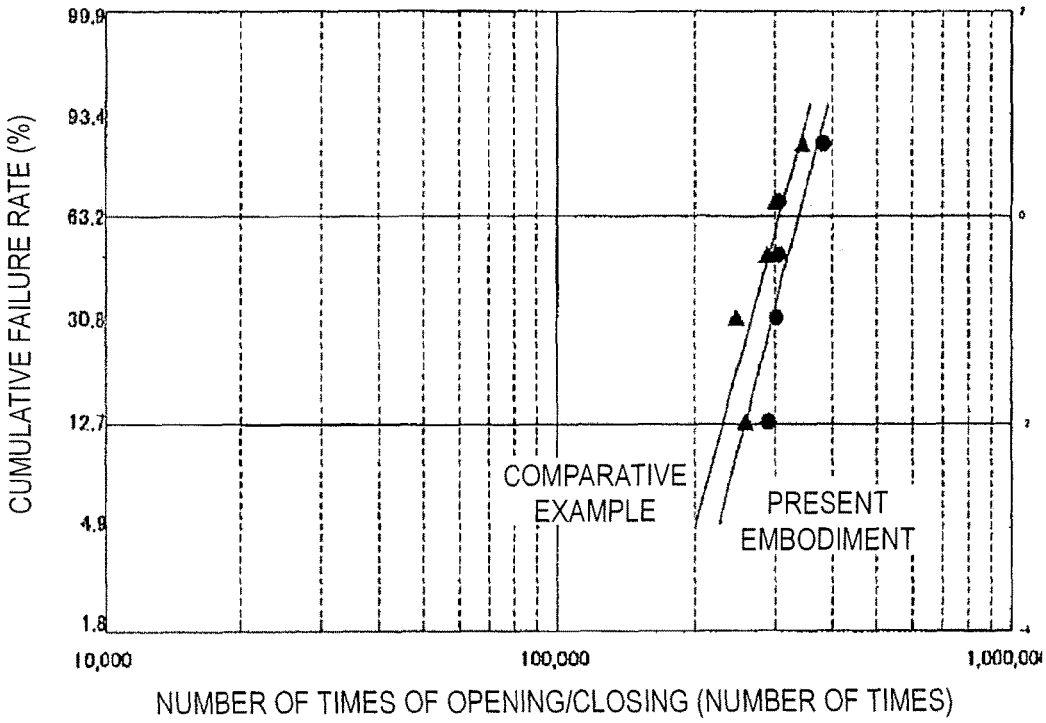
FIG. 5 is a diagram illustrating durability test results of the present embodiment and a comparative example.

Test Voltage: AC 100 V
Test Current: 10 A
Load: Resistance load
Frequency of opening/closing: ON for one second/OFF for 10 seconds
Contact force: $1.96\times10^{-1}$ N (20 gf)
Movable Contact Dimensions: ϕ3.0 mm×t 0.35 mm The durability test was conducted with a plurality of relay test machines, and the numbers of times of opening/closing of the durability life, at which failure occurred in each relay, was plotted on a Weibull probability paper. Results are illustrated in FIG. 5. From FIG. 5, a characteristic life of each rivet-type contact was about 340,000 times in the present embodiment, and about 300,000 times in the comparative example. Therefore, it has been confirmed that the rivet-type contact of the present embodiment is excellent in the durability life.

Figure 6:
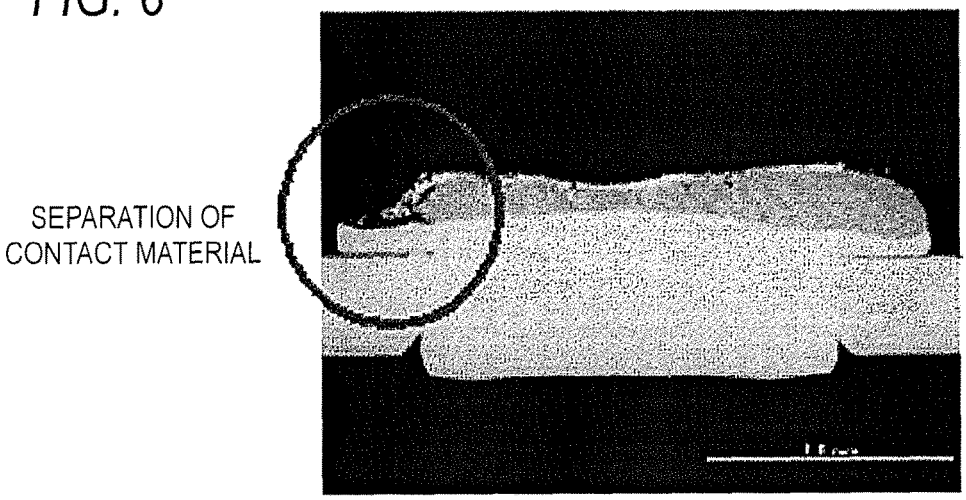
FIG. 6 is a photograph of a head part (contact material) of the comparative example after the durability test.

FIG. 6 is an enlarged photograph of a head part of the rivet-type contact of the comparative example after the durability test. In an end part of the contact material, the consumption is severe, and separation of the contact material is seen.

INDUSTRIAL APPLICABILITY

The two-layer rivet-type contact according to the present invention suppresses the separation/dropout of the contact material in the use process. In the present invention, improvement of the durability life is added to the primary characteristic of the two-layer rivet-type contact, which is the decrease in the amount of use of the contact material and the suppression of the member cost.

The invention claimed is:

1. A rivet-type contact comprising:

a rivet having a head part and a leg part, wherein the head part and the leg part share a longitudinal axis;

the head part made of a contact material and having a height Y in the direction of the longitudinal axis and having a width, wherein the contact material comprises Ag or an Ag alloy; and the leg part having a narrower width than that of the head part, the leg part deformed such that a diameter of the leg part becomes larger than that of a hole drilled in a base when the rivet is fixed to the base and comprises Cu or a Cu alloy, wherein when the rivet-type contact is fixed to the base, the leg part has, in an end part of a side of the head part, a flange part having a larger width than that of the leg part and having a smaller width than that of the head part, the flange part preventing the contact material from coming into contact with the hole of the base, the flange part is embedded in the head part to a depth X in the direction of the longitudinal axis, such that a lower end surface of a flange part and a lower end surface of a head part are approximately flat and coplanar, and a ratio X/Y is between ⅓ and 1/10, and a length (l) between an endmost part of the flange part and a starting point of the leg part satisfies $0.5L \leq l \leq 0.9L$ with respect to a length (L) between an endmost part of the head part and the starting point of the leg part.

2. A method of manufacturing a rivet-type contact, the contact defined in claim 1, comprising the steps of:

butting a first billet comprising a contact material and a second billet comprising a base material against each other and pressure-welding the both billets to manufacture a joined material;

combining a joining punch having a recessed space and a joining dice having a cylindrical space to form a rivet-shaped space;

pressing the joined material into the space of the joining punch from a lower part of the joining dice; and filling the space in the joining punch with the first billet to form a head part, and embedding a part of the second billet in the head part to form a flange part.

3. The method of manufacturing the rivet-type contact according to claim 2, wherein the process of pressure-welding the first billet and the second billet to obtain the joined material is pressure welding with a load of 0.5 to 2 ton·f.

4. The method of manufacturing the rivet-type contact according to claim 2, comprising:

a process of pressing and molding the head part after the formation of the head part and the flange part.

5. The method of manufacturing the rivet-type contact according to claim 3, comprising:

a process of pressing and molding the head part after the formation of the head part and the flange part.

6. A rivet-type contact comprising:

a rivet having a head part and a leg part, wherein the head part and the leg part share a longitudinal axis;

the head part made of a contact material and having a height Y in the direction of the longitudinal axis and having a width, wherein the contact material comprises Ag or an Ag alloy; and the leg part having a narrower width than that of the head part, the leg part deformed such that a diameter of the leg part becomes larger than that of a hole drilled in a base when the rivet is fixed to the base and comprises Cu or a Cu alloy, wherein when the rivet-type contact is fixed to the base, the leg part has, in an end part of a side of the head part, a flange part having a larger width than that of the leg part and having a smaller width than that of the head part, the flange part preventing the contact material from coming into contact with the hole of the base, the flange part is embedded in the head part to a depth X in the direction of the longitudinal axis, and a ratio X/Y is between ⅓ and 1/10, such that an undersurface of the flange is not covered by the contact material and the uncovered undersurface of the flange and an adjoining portion of the leg form a single material contact surface for contacting a surface to be riveted, and a length (l) between an endmost part of the flange part and a starting point of the leg part satisfies $0.5L \leq l \leq 0.9L$ with respect to a length (L) between an endmost part of the head part and the starting point of the leg part.

* * * * *